US006625404B2

(12) United States Patent
Watanabe et al.

(10) Patent No.: US 6,625,404 B2
(45) Date of Patent: Sep. 23, 2003

(54) APPARATUS FOR CONTROLLING THE AMOUNT OF DEVELOPER MATERIAL AND TONER CONCENTRATION

(75) Inventors: Takeshi Watanabe, Ichikawa (JP); Shoko Shimmura, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/053,561

(22) Filed: Jan. 24, 2002

(65) Prior Publication Data

US 2003/0138259 A1 Jul. 24, 2003

(51) Int. Cl.[7] ..... G03G 15/08; G03G 15/10

(52) U.S. Cl. ..... 399/30; 399/58; 399/27; 399/260; 399/262

(58) Field of Search ..... 222/DIG. 1; 399/24, 399/27, 29, 30, 58, 59, 61, 62, 255, 256, 262, 263

(56) References Cited

U.S. PATENT DOCUMENTS

| | | | | |
|---|---|---|---|---|
| 4,614,165 A | | 9/1986 | Folkins et al. | |
| 4,899,690 A | | 2/1990 | Hacknauer et al. | |
| 5,095,338 A | | 3/1992 | Hayes, Jr. et al. | |
| 5,430,532 A | | 7/1995 | Ueda et al. | |
| 5,436,703 A | | 7/1995 | DeYoung et al. | |
| 5,533,443 A | | 7/1996 | Stotz et al. | |
| 5,548,385 A | | 8/1996 | Takai et al. | |
| 5,592,270 A | * | 1/1997 | Takai et al. | 399/260 |

FOREIGN PATENT DOCUMENTS

| | | |
|---|---|---|
| JP | 2-21591 | 5/1990 |
| JP | 7-11598 | 1/1995 |
| JP | 2574588 | 10/1996 |
| JP | 10-63074 | 3/1998 |
| JP | 10-90991 | 4/1998 |
| JP | 2837309 | 10/1998 |
| JP | 2891845 | 2/1999 |
| JP | 2891848 | 2/1999 |
| JP | 3005138 | 11/1999 |
| JP | 3014563 | 12/1999 |

* cited by examiner

*Primary Examiner*—Hoang Ngo
(74) *Attorney, Agent, or Firm*—Foley & Lardner

(57) ABSTRACT

A developing apparatus is provided in which a developer material in a development tank is made to circulate through a developer material storage vessel detachably mounted on the development tank, thereby prolonging the service life of the developer material. In the developing apparatus of the present invention, a predetermined developer material composed of a toner and a carrier stored in a development tank 31 is stirred by a stirring roller 33, and supplied to a latent image formed on a photoreceptor 11 by means of a development roller 32 in the development tank to visualize the latent image. The concentration of the toner consumed in the development tank is detected by a toner concentration sensor 34 so that toner is supplied from a toner storage tank 41 to the development tank so as to maintain the concentration of the toner at a constant level. In this case, a developer material conveyor shaft 37*a* discharges the developer material from the development tank to a developer material storage vessel 50, and a developer material conveyor shaft 37*b* makes the developers material received from the developer material storage tank into the development tank thereby to control the amount of developer material and the concentration of the toner in the development tank to be constant. The developer material storage vessel is replaced with a new one at proper times so as to gradually refresh the developer material therein.

11 Claims, 10 Drawing Sheets

| | | LIFE NUMBER OF SHEETS | | | | | |
|---|---|---|---|---|---|---|---|
| | | 20k | 40k | 60k | 80k | 100k | 200k |
| (A1)... | PRESENT INVENTION NOT APPLIED | 0 | x | | | | |
| (A2)... | DEVELOPER MATERIAL STORAGE VESSEL STORING DEVELOPER MATERIAL OF 42 g WAS REPLACED WITH NEW ONE 10k SHEETS BY 10k SHEETS | 0 | 0 | 0 | 0 | 0 | 0 |
| (A3)... | TONER CARTRIDGE CONTAINING CARRIER OF 40g WAS REPLACED WITH NEW ONE ABOUT 6k SHEETS BY ABOUT 6k SHEETS. | 0 | 0 | 0 | 0 | 0 | 0 |
FIG. 9
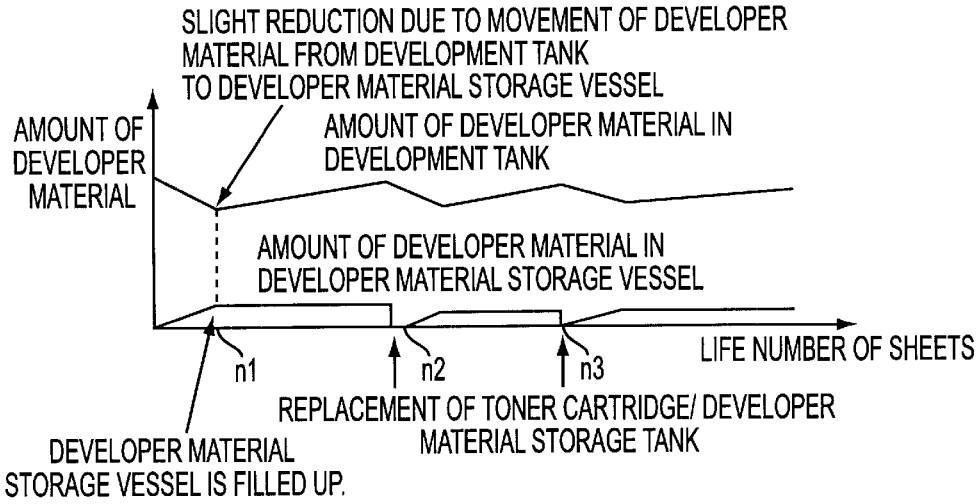
FIG. 10
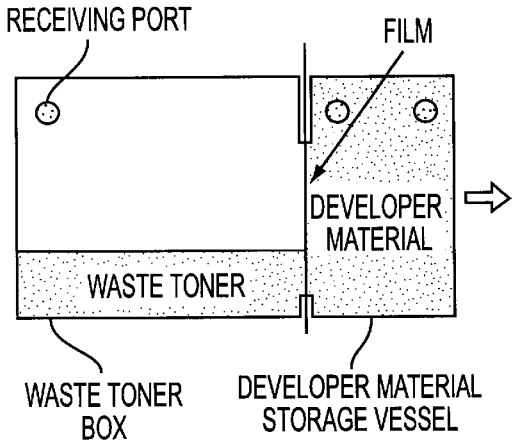
FIG. 11(a)
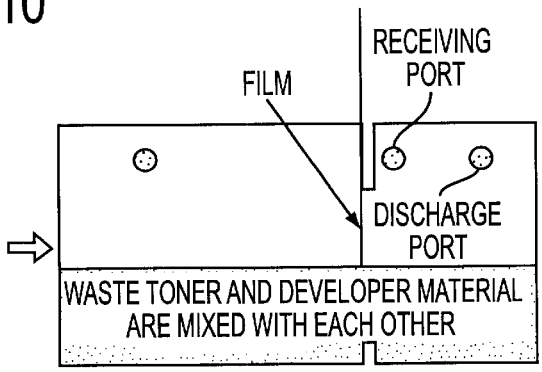
FIG. 11(b)

| | | LIFE NUMBER OF SHEETS | | | | | |
|---|---|---|---|---|---|---|---|
| | | 20k | 40k | 60k | 80k | 100k | 200k |
| (B1)... | PRESENT INVENTION NOT APPLIED | 0 | 0 | x | | | |
| (B2)... | REPLACEMENT OF DEVELOPER MATERIAL REPLENISHMENT TANK PER ABOUT 20k SHEETS (REPLACEMENT OF DEVELOPER MATERIALOF ABOUT 85 g) | 0 | 0 | 0 | 0 | 0 | 0 |
| (B3)... | DEVELOPER MATERIAL STORAGE BOX HAVING CARRIER OF 40g MIXED THEREWITH (REPLACEMENT PER ABOUT 6k SHEETS) | 0 | 0 | 0 | 0 | 0 | 0 |

APPARATUS FOR CONTROLLING THE AMOUNT OF DEVELOPER MATERIAL AND TONER CONCENTRATION

BACKGROUND OF THE INVENTION

1. Field of the Invention

The present invention relates to a developing apparatus, and more specifically, to a developing apparatus which controls the amount of a developer material composed of a toner and a carrier and the concentration of the toner stored in a development tank to be constant in order to supply a developer material of a constant quality to a photoreceptor through a developing roller for visualization of a latent image formed on the photoreceptor.

2. Description of the Related Art

In dry electrophotographic printers and the like, there has been widely used a developing apparatus which develops or visualizes a latent image formed on a photoreceptor by means of a developer material composed of a toner and a carrier, that is, a two-component developer material. In this kind of known developing apparatus, though the toner is consumed upon each printing operation, the carrier is not consumed but caused to circulate in the developing apparatus while being stirred. As the carrier is circulated while being stirred in this manner, a resin coating on the surface of each particle of the carrier might be peeled off, permitting the toner to be fused to the surfaces of carrier particles. As a result, an electrification function of the carrier is deteriorated, so the visualization of the latent image cannot be performed excellently. As proposals for solving this problem, there are inventions disclosed in Japanese Patent Publication No. 7-11598 and U.S. Pat. No. 4,614,165. In these inventions, it is intended to prolong the service life of a carrier in a developing apparatus substantially to that of the apparatus by replenishing the carrier little by little together with a toner. However, in these inventions, the carrier is replenished little by little at a speed determined according to a certain function, and hence the contents disclosed therein are very conceptual, so it is necessary to devise various ways and means in order to implement these inventions as concrete devices.

As one of such contrivances described above, there is an invention disclosed in Japanese Patent Publication No. 2-21591. In this invention, a carrier is gradually replenished to a developing apparatus, and a developer material overflowing from a weir of a prescribed height is collected or recovered as a discharged developer material. This method is generally called an overflow method, and there is an invention related to this method which is disclosed in U.S. Pat. No. 5,436,703. The invention of U.S. Pat. No. 5,436,703 discloses such a construction that a developer material is caused to overflow from a first chamber to a second chamber, and conveyed therefrom to a discharge port by means of a conveyor device, arranged in the second chamber. Also, Japanese Patent No. 2,891,845 and U.S. Pat. No. 5,430,532 disclose measures for coping with the case in which a developing apparatus employing an overflow method is inclined during movement thereof. Japanese Patent No. 2,891,848 discloses an invention which employs an overflow method and at the same time measures the weight of a developing apparatus and the like so as to maintain the amount of developer material in the developing apparatus at a proper level. In these developing apparatuses employing the overflow method, however, there is a tendency that an exchange or replacement ratio of the existing developer material to a freshly supplied unused developer material is varied depending upon the amount of toner consumed per sheet of paper, resulting in the unstable quality of a printed image. In order to improve these problems, complicated devices such as a weight detecting device and the like are required.

Thus, a developing apparatus without using an overflow method will be considered. As improved techniques for controlling the discharge of a developer material in such a developing apparatus, there are known inventions disclosed in Japanese Patent No. 2,574,588 and U.S. Pat. No. 5,095,338. These inventions control the discharge of the developer material by arranging a magnetic curtain at a developer material discharge port. In addition, in an invention disclosed in Japanese Patent No. 2,837,309, a shutter is disposed at a discharge port of a developing apparatus for controlling a developer material in such a manner that the developer material is prevented from being discharged from the discharge port during the time when an image forming operation is carried out. In this case, however, in order to stabilize the operation of the developing apparatus, it is necessary to detect the total amount of developer material and the amount of discharged developer material in addition to the concentration of the toner thereby to control a developer material supply means and a toner supply means, as disclosed in U.S. Pat. No. 5,548,385. Alternatively, it is necessary to detect the amount of toner consumed and perform discharge control so as to maintain the amount of developer material at a prescribed level, as disclosed in Japanese Patent Application Laid-Open No. 10-63074 or Japanese Patent Application Laid-Open No. 10-90991. Accordingly, these measures are rather complicated in construction to put into practice.

In this manner, the above-mentioned conventional developing apparatuses, whether employing an overflow method or not, are complicated in construction. Then, a proposal for simplifying the constructions of these developing apparatuses has been made in Japanese Patent No. 3,005,138. By applying the technique disclosed therein, it is possible to prolong the usable life of a developer material in a developing apparatus by supplying a fresh developer material from a developer material replenishment tank to the developing apparatus little by little, and at the same time by discharging the developer material in the developing apparatus from a discharge port thereby to gradually refresh the developer material in the developing apparatus. In this technique, however, it is necessary to replenish and discharge the developer material very little by very little at the same time, and if otherwise, the developer material will fill up a discharge tank in a short time. In addition, it is not convenient to use because it is necessary to exchange the replenishment tank and the discharge tank, respectively, each time they are emptied or filled up. The cause of this is a one-way flow of the developer material in a direction from the replenishment tank to the discharge tank.

SUMMARY OF THE INVENTION

The present invention is intended to solve the above-mentioned problems, and has for its object to provide a developing apparatus which is simple in structure, and is capable of preventing deterioration of a developer material in the developing apparatus, by detachably mounting a developer material storage vessel with a fresh developer material stored therein on a development tank so that the developer material gradually discharged from the development tank is received in the developer material storage vessel and mixed with the developer material thus far stored in the developer material storage vessel, then an amount of developer material thus mixed equal to the amount of developer material discharged to the developer material storage vessel being returned to the developing apparatus.

To solve the above-mentioned problems, the present invention resides in a developing apparatus for supplying a developer material composed of a toner and a carrier to a photoreceptor to visualize a latent image formed on the photoreceptor. The apparatus includes: a development tank for storing the toner and the carrier; a development roller for supplying the toner and the carrier in the development tank to the photoreceptor; and developer material refreshing means for mechanically forcing the development tank to supply and receive the toner and the carrier, which together constitute the developer material, so as to prevent changes in the amount of the developer material and in the concentration of the toner in the development tank.

According to the above construction, the service life of the developer material can be prolonged by forcedly refreshing the developer material in the development tank little by little by forcedly exchanging the developer material in the development tank, which has reached a certain fixed height, under the action of the developer material refreshing means without depending on an overflow of the developer material in the development tank alone as in the above-mentioned conventional apparatuses.

In addition, in the present invention, the developer material refreshing means includes: toner concentration adjusting means for supplying a toner to the developer material stored in the development tank thereby to set the concentration of the toner therein to a target toner concentration; a developer material storage vessel detachably mounted on the development tank for storing a developer material of the target toner concentration; and a developer material discharging and receiving mechanism for mixing the developer material stored in the development tank with the developer material stored in the developer material storage tank a prescribed amount by a prescribed amount, and circulating them into the development tank without giving a change equal to or greater than a predetermined amount to the amount of developer material stored in the development tank.

Moreover, in the present invention, the developer material refreshing means includes: discharging and conveying means for discharging and conveying the developer material in the development tank a prescribed proper amount by a prescribed proper amount; developer material replenishment means for storing a developer material of a target toner concentration and supplying the developer material in such a manner that the amount of developer material stored in the development tank becomes constant; and a high concentration developer material storage part detachably mounted on the developer material replenishment means for storing a high concentration developer material of a toner concentration higher than the target toner concentration, receiving, the developer material discharged from the discharging and conveying means to mix it with the high concentration developer material, and delivering the mixed developer material to the developer material replenishment means when the toner concentration of the mixed developer material has reached the target toner concentration.

Further, in the present invention, the developer material refreshing means includes: discharging and conveying means for discharging and conveying the developer material in the development tank a prescribed proper amount by a prescribed proper amount; developer material replenishment means for storing a developer material of a target toner concentration and supplying the developer material in such a manner that the amount of developer material stored in the development tank becomes constant; toner replenishment means for replenishing the amount of the toner; and developer material stirring means for receiving the developer material from the discharging and conveying means and the toner from the toner replenishment means to mix them with each other to produce a mixed developer material, and delivering the mixed developer material to the developer material replenishment means when the toner concentration of the mixed developer material has reached the target toner concentration. The developer material replenishment means is removable from the development tank and the developer material stirring means connected therewith.

Furthermore, in the present invention, the developer material refreshing means includes: discharging and conveying means for discharging and conveying the developer material in the development tank a prescribed proper amount by a prescribed proper amount; developer material replenishment means for storing a developer material of a target toner concentration and supplying the developer material in such a manner that the amount of developer material stored in the development tank becomes constant; a high concentration developer material storage part for storing a high concentration developer, material of a toner concentration higher than the target toner concentration; developer material conveying means connected with the high concentration developer material storage part; and developer material stirring means for mixing the developer material discharged from the discharging and conveying means and the high concentration developer material in the high concentration developer material storage part received from the developer material conveying means to produce a mixed developer material, and delivering the mixed developer material to the developer material replenishment means when the toner concentration of the mixed developer material has reached the target toner concentration. When the high concentration developer material storage part is emptied, the developer material conveying means conveys the developer material in a reverse direction from the developer material stirring means the high concentration developer material storage part so that an amount of carrier stored in the high concentration developer material storage part at the time of initialization is maintained in the high concentration developer material storage part so as to make it possible to replace the high concentration developer material storage part with a new one.

Further, the present invention resides in a developing apparatus in which a predetermined amount of developer material composed of a toner and a carrier stored in a development tank is stirred by stirring means and supplied to a latent image, which is formed on a photoreceptor in accordance with an electrophotographic method, by a development roller arranged in the development tank to visualize the latent image, a concentration of a toner consumed in the development tank being detected by a toner concentration sensor whereby the toner in the toner storage tank is supplied to the development tank so as to maintain the toner concentration therein at a constant value. The developing apparatus includes: developer material discharging means for mechanically discharging the developer material from the development tank; developer material receiving means for receiving the developer material into the development tank; developer material storage means detachably mounted on the developer material discharging means and the developer material receiving means for storing in advance the same developer material as that stored in the development tank at the time of initialization; and control means for driving the developer material discharging means to discharge a predetermined amount of developer material from the development tank to the developer material storage means so as to mix the developer material discharged from the development tank and the developer material already stored in the developer material storage means with each other, the control means further driving the developer material receiving means in such a manner that the development tank is made to receive from the developer material storage means an amount of mixed developer material corresponding to an amount of developer material discharged from the development tank.

Still further, in the present invention, the developer material, which is caused to circulate through the developer material storage means by the control means, is a developer material whose height in the development tank becomes equal to or higher than a predetermined height level.

Besides, in the present invention, the conveyance capacity of the developer material receiving means for conveying the developer material is greater than that of the developer material discharging means.

In addition, in the present invention, a discharge port, through which the developer material discharging means discharges the developer material from the development tank, and a receiving port, through which the developer material receiving means makes the developer material received in the development tank, are set at locations opposing to each other in such a manner that a distance between the discharge port and the receiving port in the development tank is longer than a direct distance therebetween in a straight line.

Moreover, in the present invention, the control means circulates the developer material through the developer material storage means when image formation is not performed.

Further, in the present invention, the developer material storage means is integral with the toner storage tank.

BRIEF DESCRIPTION OF THE DRAWINGS

FIG. 2(*b*) is a view explaining the state in which a developer material storage vessel shown in FIG. 2(*a*) is removed.

FIG. 6 is a cross sectional side view in which FIG. 5 is seen from the right.

FIG. 8(*b*) is a view of a reduced scale showing the integrated parts alone of FIG. 8(*a*).

FIG. 9 is a view explaining the results of life tests using the developing apparatus of FIG. 1 in a different method.

FIG. 10 is a graph illustrating a change in the amount of the developer material in each of the development tank and the developer material storage vessel according to the exchange of the toner cartridge and the developer material storage vessel when the test results of FIG. 9 are obtained.

FIG. 11(*a*) is a view illustrating an example in which the developer material storage vessel and the waste toner box are integrated with each other FIG. 11(*b*) is a view illustrating how the height of the developer material decreases when a film constituting a partition shown in FIG. 11(*a*) is removed.

FIG. 13(*b*) is a view illustrating that the shutter of the developing apparatus of FIG. 12 is closed again.

DESCRIPTION OF THE PREFERRED EMBODIMENTS

Figure 1:
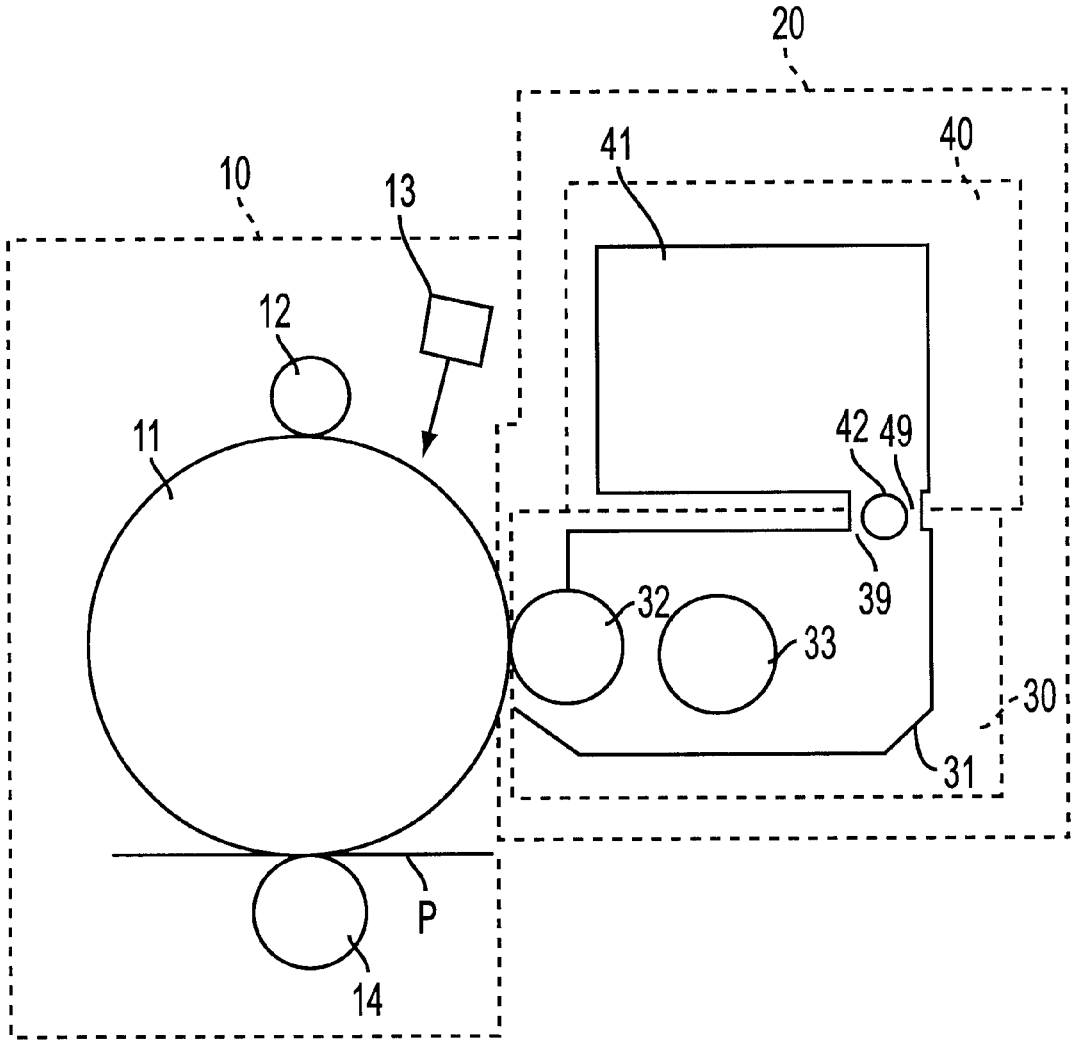
FIG. 1 is a cross sectional view illustrating a first embodiment of a developing apparatus of the present invention installed on an image forming apparatus.
Figure 2A:
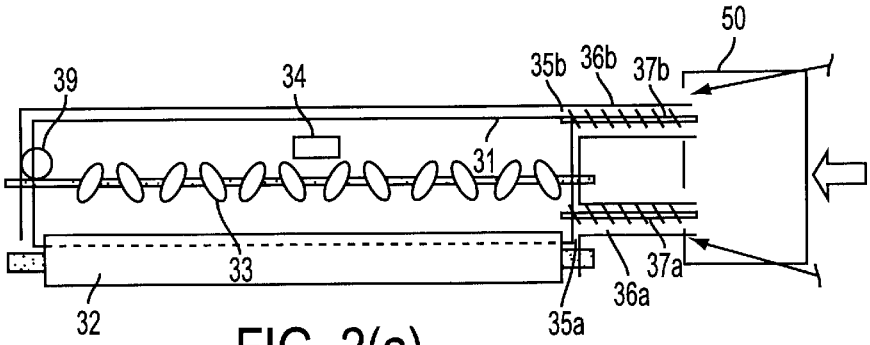
FIG. 2(*a*) is a cross sectional view of essential portions when the developing apparatus shown in FIG. 1 is seen from above.
Figure 2B:
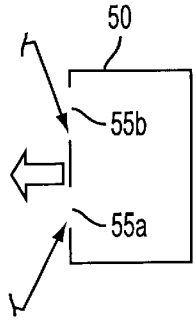
Figure 3:
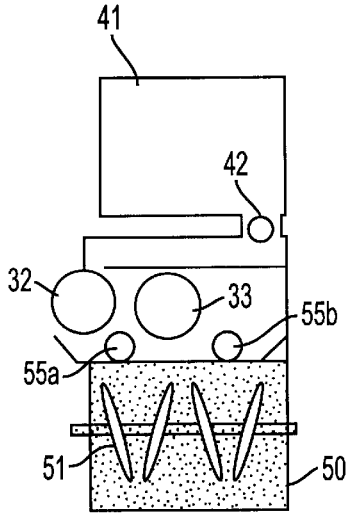
FIG. 3 is a cross sectional side view of the developing apparatus shown in FIG. 2(*a*).
Figure 4:
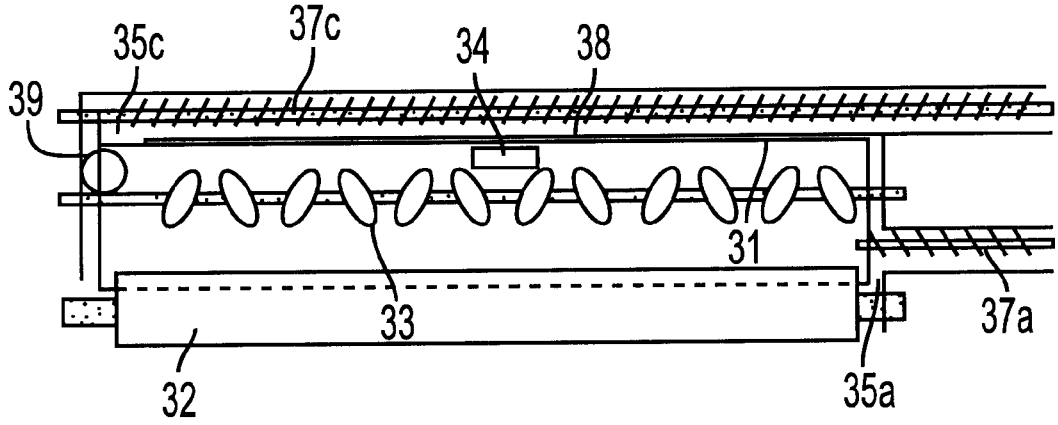
FIG. 4 is a cross sectional view of a modification of the developing apparatus of FIG. 1, illustrating a second embodiment of the developing apparatus of the present invention.
Figure 5:
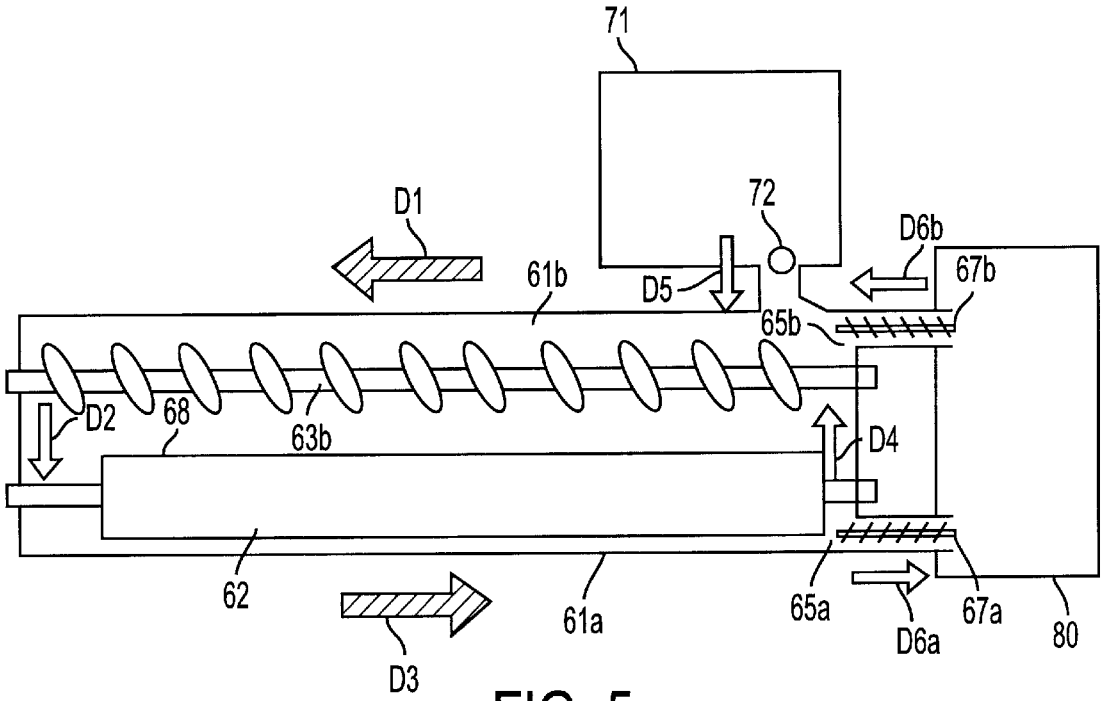
FIG. 5 is a cross sectional view of a modification of the developing apparatus of FIG. 1, illustrating a third embodiment of the developing apparatus of the present invention.
Figure 6:
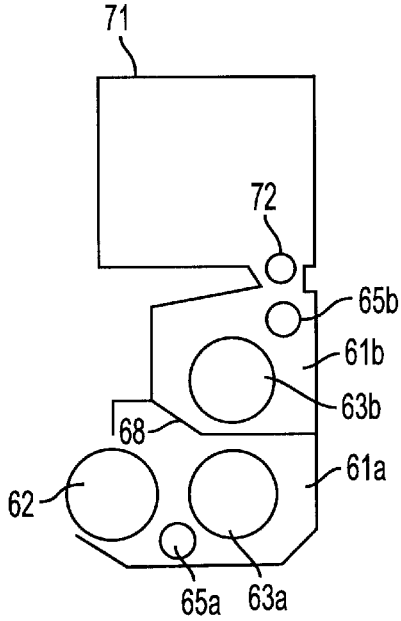

Hereinafter, preferred embodiments of the present invention will be described based on the accompanying drawings. FIG. 1 is a cross sectional view in which a first embodiment of the developing apparatus of the present invention is installed on an i image forming apparatus. FIG. 2(*a*) is a cross sectional view of essential portions when the developing apparatus shown in FIG. 1 is seen from above. FIG. 2(*b*) is a view explaining the state in which a developer material storage vessel of FIG. 2(*a*) is removed. FIG. 3 is a cross sectional side view of the developing apparatus shown in FIG. 2(*a*). FIG. 4 is a cross sectional view of a modification of the developing apparatus of FIG. 1, showing a second embodiment of the developing apparatus of the present invention. FIG. 5 is a cross sectional view of a modification of the developing apparatus of FIG. 1, showing a third embodiment of the developing apparatus of the present invention. FIG. 6 is a cross sectional side view in which FIG. 5 is seen from the right

Embodiment 1

In the image forming apparatus shown in FIG. 1 and FIG. 2, a developer material is supplied to a printing functional part 10 from a developing apparatus 20 and printing is effected on a sheet of printing paper (a member to which an image is transferred) which is fed to the printing functional part 10. The printing functional part 10 includes a photoreceptor 11, an electrification roller 12, an exposure device 13, a transfer roller 14 and so on. Around the periphery of the drum-shaped photoreceptor 11, there are provided other various devices such as a cleaning device, a diselectrification device and so on, but to facilitate understanding, only those portions required for explanation are shown in FIG. 1. The surface of the rotating photoreceptor 11 is electrified by the electrification roller 12. Light rays corresponding to an original document to be printed are irradiated from the exposure device 13 onto the surface of the electrified photoreceptor 11 to form thereon an electrostatic latent image. A developer material is supplied from the developing apparatus 20 to the latent image on the photoreceptor 11 so that the latent image is thereby developed or visualized. The photoreceptor 11 cooperates with the transfer roller 14 to transfer the developed or visualized toner image to a sheet of printing paper P (or an intermediate transfer member) being fed thereto.

The developing apparatus 20 is constituted by a development part 30, a toner supply part 40 and a developer material storage vessel 50. The development part 30 includes a development tank 31 for storing a predetermined amount of developer material, a development roller 32 (for instance, a magnet roller) arranged in the development tank 31 in parallel with the photoreceptor 11 for supplying the developer material to the photoreceptor 11, a stirring roller 33 arranged in the development tank 31 in parallel with the development roller 32 for stirring the developer material in the development tank 31, the toner supplied from the toner supply part 40, and a refreshing developer material sent from the developer material storage vessel 50, and a toner concentration sensor 34 (see FIG. 2) for measuring the concentration of the developer material in the development tank 31. A magnetic permeability sensor or the like is preferred as the toner concentration sensor.

In addition, a developer material discharge port 35*a* and a developer material receiving port 35*b* are provided at prescribed heights on a side surface (see FIG. 2(*a*)) of the development tank 31 to which the developer material storage vessel 50 is to be mounted. A discharge tube 36*a* and a receiving tube 36*b* are connected at their one end to the discharge port 35*a* and the receiving port 35*b*, respectively. The developer material storage vessel 50 is detachably mounted on the discharge tube 36*a* and the receiving tube 36*b* at the other ends thereof Developer material conveyor shafts 37*a*, 37*b* (augers in this example) are arranged in the discharge tube 36*a* and the receiving tube 36*b*, respectively. The developer material conveyor shaft 37*a* operates to discharge the developer material, which has reached the height or vertical level of discharge port 35*a* extending from the development tank 31, to the developer material storage vessel 50. The developer material conveyor shaft 37*b* operates to cause the developer material, which has reached the height or vertical level of the developer material receiving port 35*b* in the developer material storage vessel 50, to be received in the development tank 31. In addition, a toner receiving opening 39 for receiving the toner from the toner supply part 40 is provided on the top surface of the development tank 31 at a location near a side surface thereof opposite the side surface on which the discharge port 35*a* and the receiving port 35*b* are provided.

The toner supply part 40 has a toner storage tank 41 and a toner supply roller 42 arranged in a toner supply port 49. The toner storage tank 41 receives a toner which is one of components of the developer material. The toner supply roller 42 is driven by a control part (not shown) to cause the toner in the toner storage tank 41 to drop from the toner supply port 49 in the bottom of the toner storage tank into the development tank 31 via the toner receiving opening 39. The control part usually controls the amount of the toner dropped to the development tank 31 according to the length of time for driving the toner supply roller 42. The stirring roller 51 is built into a lower portion of the developer material storage vessel 50. On one side surface of the developer material storage vessel 50, there are provided a receiving port 55*a* and a discharge port 55*b* for attachment of the ends of the discharge tube 36*a* and the receiving tube 36*b*, respectively, of the development part 30.

Now, reference will be made to the operation of the developing apparatus 20 shown in FIG. 1 and FIG. 2. At the time of initialization of the apparatus, only a prescribed amount of developer material with a prescribed ratio of the toner and the carrier by weight is stored in the development tank 31 of the development part 30. In addition, only a prescribed amount of fresh developer material of the same content is stored in the developer material storage vessel 50. When the apparatus is started to operate in such a state, the developer material in the development tank 31 is stirred by the stirring roller 33. The developer material thus stirred is supplied to the surface of the photoreceptor 11 by means of the development roller 32 to visualize or develop a latent image on the surface, of the photoreceptor 11. As such a visualization or development process is continued, the toner concentration of the developer material decreases, and the decrease in the toner concentration is detected by the toner concentration sensor 34. The control part drives the toner supply roller 42 based on the detection result of the toner concentration sensor 34 so that the toner is supplied from the toner storage tank 41 to the development tank 31 so as to control the concentration of the toner in the development tank 31 to a prescribed target toner concentration.

In this manner, the toner is replenished and stirred so as to provide a constant concentration of the toner in the development tank 31. However, the control part drives the developer material conveyor shaft 37*a* so that a portion of the developer material used for the visualization of the latent image, which has reached the discharge port 35*a*, is forced to be fed to the developer material storage vessel 50 through the discharge tube 36*a*. The developer material fed to the developer material storage vessel 50 is mixed with the fresh developer material in the developer material storage vessel 50 by means of the stirring roller 51 which is driven to rotate by the control part. On the other hand, the control part drives the developer material conveyor shaft 37*b* so that the developer material thus fed to the developer material storage vessel 50 is mixed with the fresh developer material in the developer material storage vessel 50. The developer material having reached the discharge port 55*b* is forced to be fed to the development tank 31 through the receiving tube 36*b*. The carrier in the developer material is gradually deteriorated as image formation (printing) progresses. However, the carrier is refreshed by the circulation of the developer material containing a new carrier from the developer material storage vessel 50, whereby the deterioration of the carrier is delayed. In addition, whenever a prescribed amount of images is formed, the developer material storage vessel 50 is exchanged for a new developer material storage vessel 50 which stores a fresh developer material.

Thus, the concentration of the toner in the development tank 31 is managed under the control of the control part to maintain the constant concentration of the toner by means of the toner concentration sensor 34 and the toner supply roller 42. At the same time, as for the carrier in the developer material in the development tank 31, an amount of mixed developer material substantially equal to the amount of developer material fed from the development tank 31 to the developer material storage vessel 50 is returned to the development tank 31 by the conveyance of the developer material conveyor shafts 37*a*, 37*b*. That is, the developer material in the development tank 31 is circulated and refreshed little by little (by a prescribed amount) via the developer material storage vessel 50. Therefore, the amount of carrier is not varied (i.e., not varied, in a prescribed amount or more), and the deterioration thereof is delayed. In addition, when the amount of images formed (printing) has reached a prescribed threshold (for instance, when 10,000 sheets of printing paper have been printed), the developer material storage vessel 50 is exchanged for a new one storing a new developer material. As a result, the deterioration of the carrier in the development tank 31 is further delayed so that formation of excellent images continues for a long period of time. In this case, the circulation of the developer material between the development tank 31 and the developer material storage vessel 50 is determined only by the height of the discharge port 35*a* or the height of the receiving port 35*b* without the need for any special developer material amount detection means. Moreover, it is only required to exchange the developer material storage vessel 50 when the deterioration of the carrier therein has advanced to a certain degree, so the work needed at such a time is easy.

Although in the above example, the developer material conveyor shafts 37*a*, 37*b* can be driven to operate at all times, they may instead be driven intermittently at proper timing as long as the height of the developer material in the developer material storage vessel 50 can be kept at a constant level. Moreover, a sensor for detecting the amount of developer material in the developer material storage vessel 50 may be provided in such a manner that the developer material conveyor shafts 37*a*, 37*b* can be driven in accordance with the amount of developer material detected by the sensor. In addition, it is desired that an exchange of the developer material storage vessel 50 be made as simple as possible because it must be exchanged for a new one at proper times. In that case, a transparent window may be provided at a prescribed height of the developer material storage vessel 50 for detecting the amount of developer material by means of an optical sensor or a magnetic sensor from the apparatus proper side such as the development part 30, etc. Additionally a measuring means may be provided for detecting the weight of the developer material storage vessel 50 so that the developer material conveyor shafts 37*a*, 37*b* can be controlled based on the measurement of the measuring means.

Embodiment 2

Reference will be made to a second embodiment of the present invention which is a modification of the developing apparatus shown in FIG. 1 and FIG. 2 while referring to FIG. 3 and FIG. 4. This modification is different from the first embodiment in the following features in comparison therewith. The developer material conveyor shaft 37*b* in the first embodiment is extended to the vicinity of a side opposite the side at which the receiving port 35*b* is located, to form a developer material conveyor shaft 37*c*. In addition, the developer material conveyor shaft 37*b* is separated from the development tank 31 and the like by a partition 38 at a receiving port 35*c* near a side opposite the side at which the developer material conveyor shaft 37*c* extends to the interior of the development tank 31. Accordingly, a fresh developer material fed from the developer material storage vessel 50 by the developer material conveyor shaft 37*c* is received in the development tank 31 from the receiving port 35*c* apart from the discharge port 35*a*. Thus, unevenness or non-uniformity in the developer material is removed, making it possible for the fresh developer material to be more fully mixed with the developer material in the development tank 31. In this case, the positions of the ends of the developer material conveyor shafts 37*a*, 37*c* in the development tank 31 may be reversed. It is important that the ends of the developer material conveyor shafts have such a positional relation as to be in opposition to each other in a direction in which the development roller 32 and the stirring roller 33 extend in the development tank 31.

Embodiment 3

Reference will be made to a third embodiment of the developing apparatus of the present invention while referring to FIG. 5 and FIG. 6. FIG. 5 is a front elevational cross sectional view of the developing apparatus. FIG. 6 is a cross sectional side view In which FIG. 5 is seen from the right side. In a development tank lower part 61*a*, a development roller 62 and a stirring conveyor roller 63*a* (for instance, auger) are arranged in parallel with each other (FIG. 6). In the development tank upper part 61*b*, a stirring conveyor roller 63*b* is arranged at a position above the stirring conveyor roller 63*a*. A toner storage tank 71 is arranged above the development tank upper part 61*b*. Moreover, a developer material storage vessel 80 is detachably mounted on the right side of the development tank lower part 61*a* and the development tank upper part 61*b*. The development tank upper part 61*b* and the development tank lower part 61*a* are partitioned or separated at a central part by a partition 68. The developer material in the development tank upper part 61*b* is conveyed in a direction of arrow DI while being stirred by means of the stirring conveyor roller 63*b*, and fed to the development tank lower part 61*a* through an opening 68*a*, as indicated at arrow D2. The developer material in the development tank lower part 61*a* is conveyed in a direction of arrow D3 while being stirred by the stirring conveyor roller 63*a*, and fed to the development tank upper part 61*b* through an opening 68*b*, as indicated at arrow D4.

In the above-mentioned example, the toner concentration of the developer material in each of the development tank lower part 61*a* and the development tank upper part 61*b* is detected by a toner concentration sensor (not shown). In order to maintain a prescribed concentration of the toner, the control part drives the toner supply roller 72 so that the toner is replenished from the toner storage tank 71 to the development tank 61*a*, as indicated at arrow D5. In addition, in the developing apparatus as mentioned above, most of the developer materials in the development tank lower part 61*a* and the development tank upper part 61*b* are circulated in the development tank lower part 61*a* and the development tank upper part 61*b*, as shown at arrows D1–D4. However, a part of the developer material in the development tank lower part 61*a* is discharged from a discharge port 65*a* into the developer material storage vessel 80 by means of a developer material conveyor shaft 67*a*, as indicated at arrow D6*a*, so that it is mixed with the developer material in the developer material storage vessel 80. Further, an amount of developer material equal to the amount of developer material discharged to the developer material storage vessel 80 is returned from a receiving port 65*b* into the development tank upper part 61*b* by means of a developer material conveyor shaft 67*b*, as shown at arrow D6*b*. By the circulation of the developer material by way of the developer material storage vessel 80, the carrier is gradually refreshed without changing the weight ratio between the toner and the carrier in the development tank lower part 61*a* and that in the development tank upper part 61*b*, whereby the deterioration of the carriers in the development tank lower part 61*a* and the development tank upper part 61*b* can be delayed.

Figure 7:
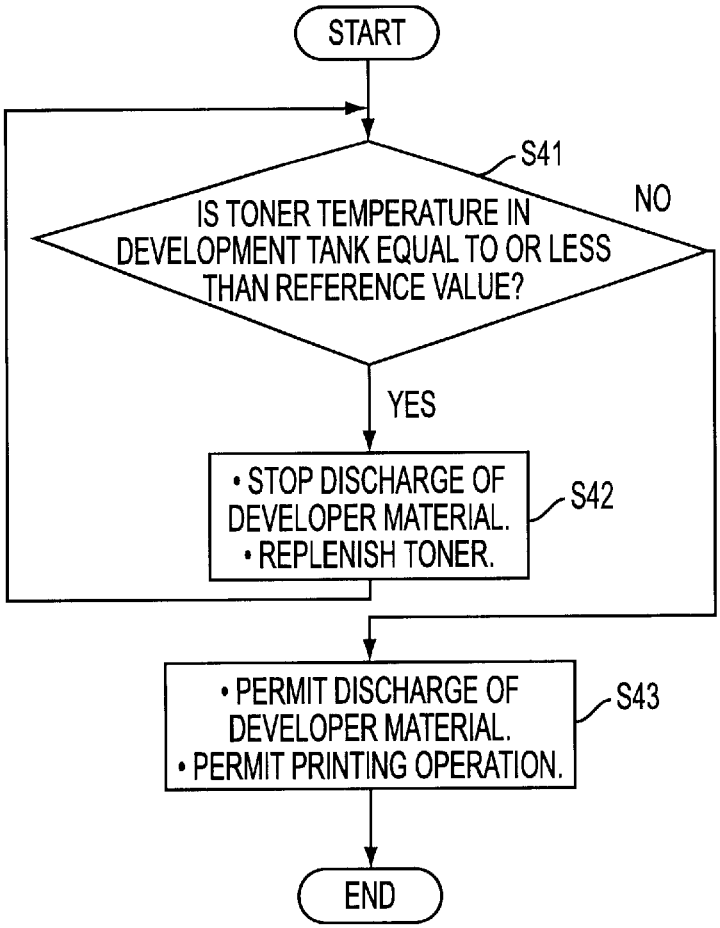
FIG. 7 is a flow chart explaining an example of a method of discharging a developer material in a developing apparatus such as, for example, the developing apparatus of FIG. 1.

Regarding the above-mentioned first through third embodiments, it is not particularly necessary to perform the control of the developer material conveyor shafts for the circulation of the developer material through the developer material storage vessel by means of the developer material conveyor shafts in relation to the developing or visualizing process for the photoreceptor, and fairly good results will be obtained even if the developer material is always made to circulate little by little. However, in case of the following conditions, it is desirable to change the measures to be taken to some extent. That is, in cases where the concentration of the toner is decreasing during image formmation, if the developer material storage tank is replaced with a new one while the discharge of the developer material from the development tank to the developer material storage vessel is continued with the concentration of the toner in the development tank being not stable or steady (that is, when the concentration of the carrier in the developer material storage vessel is high), the amount of carrier decreases, thus affecting the balance in concentration between the carrier and the toner. In order to cope with such a situation, it is preferable not to perform the discharge of the developer material to the developer material storage vessel during image formation, but to carry out the-discharge of the developer material only when the concentration of the toner in the development tank is steady. Alternatively, as shown in a flow chart of FIG. 7, it is preferable that when the toner is replenished as a result of the detection that the concentration of the toner is less than a reference value (S41), the discharge of the developer material be not carried out (S42), and that the developer material be started to be discharged after the replenishment of the toner has been completed. The reason for making such control possible is that the discharge and receipt of the developer material in the development tank can be mechanically and forcedly carried out by the developer material conveyor shafts.

Figure 8A:
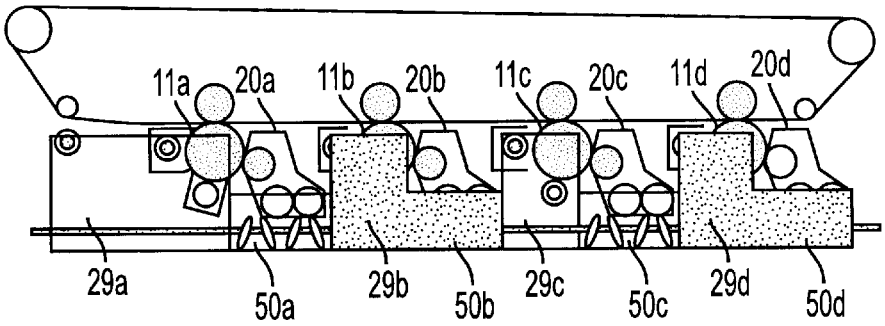
FIG. 8(*a*) is a view explaining the case where a waste toner box and a developer material storage vessel in an electrophotographic printer of the four-row tandem type are integrated with each other.
Figure 8B:
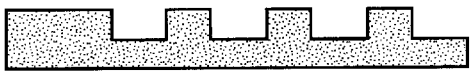

In addition, if the developer material storage vessel is integrated with the waste toner box (not shown; a recovery box for unnecessary toner on the photoreceptor) in the above-mentioned first through third embodiments, it will be possible to concurrently replace the developer material storage vessel and the waste toner box containing therein waste toner with new ones upon replacement of the developer material storage vessel 50. As a result, disposal of wastes can be carried out as an integral unit, thus making the handling thereof easy. In particular, it is convenient if such a scheme is applied to an electrophotographic printer of the four-row tandem type as shown in FIG. 8(*a*). That is, when color printing is performed with such a printer using photoreceptors 11*a*, 11*b*, 11*c* and 11*d* and developing apparatuses 20*a*, 20*b*, 20*c* and 20*d*, developer materials are discharged from the four developing apparatuses corresponding to a plurality of printing colors to the respective developer material storage vessels 50*a*, 50*b*, 50*c* and 50*d*, and waste toners are discharged from four cleaners to respective waste toner boxes 29*a*, 29*b*, 29*c* and 29*d*. If the developer material storage vessels and the waste toner boxes are integrated with each other, as shown on a reduced scale in FIG. 8(*b*), the waste toner boxes and the developer material storage vessels can be replaced together with improved efficiency.

Next, reference will be made to life test examples of the developing apparatus shown in FIG. 1 through FIG. 3. Here, it was set that the amount of carrier in the development tank 31 is 200 g (gram), and the concentration of the toner therein is 6%. Thus, the total amount of developer material in the development tank was 212.77, g. In addition, with respect to the developer material storage vessel 20, it was set that the amount of carrier is 40 g, and the concentration of the toner is similarly 6%. Thus, the total amount of developer material in the developer material storage vessel 20 was 42.55 g. In this case, the developer material is discharged from the development tank 31 to the developer material storage vessel 50 in synchronism with the movement of a main motor (not shown). Simultaneous with this discharge, the developer material having reached a constant height level or higher in the developer material storage vessel 50 is returned to the development tank 31. In this case, when the concentration of the toner in the development tank 31 decreases according to image formation, toner is supplied thereto from the toner storage tank 41. However, the total amount of the developer material stored in the development tank 31 becomes in a stable or steady state because the amount of carrier is unchanged.

Life tests were conducted under the above-mentioned operating condition with a pattern having a printing rate of about 5% being printed on sheets of printing paper of an "A" size (for instance, by the developing apparatus of FIG. 1). In the case where printing was performed without exchanging the developer material as shown in (A1) of FIG. 9, printing defects exceeded an allowable level at the time when about 40,000 sheets (also referred to as the life number of sheets 40k) were printed. On the contrary, in the case where the developer material storage vessel 50 was replaced with a new one each time 10,000 sheets were printed as shown in (A2) of FIG. 9 according to the present invention, the printing quality was within an allowable level even at the time when 200k sheets were printed. Though implemented in the following embodiments, when image formation was carried out using a toner cartridge of a cartridge type (for instance, the toner storage tank 41 of FIG. 1) which was formed by storing therein a carrier-mixed toner, in which a carrier was mixed in advance with a toner to be replenished, with the toner concentration of 80% and the total amount 200 g (the amount of carrier of 40 g) (however, note that the developer material storage vessel was emptied at the time of initization.), the results as shown in (A3) of FIG. 9 were obtained.

A graph in FIG. 10 shows a change in the amount of the developer material in the development tank and a change in the amount of the developer material in the developer material storage vessel in the life tests which provided the above results shown in (A3) of FIG. 9. That is, the amount of developer material in the development tank decreases up to a time when the number of printed sheets reaches n1, and when the amount of developer material in the development tank becomes an amount of about 160 g, the amount of developer material stored in the developer material storage vessel becomes a sufficient amount, and the amount of the developer material in the development tank shifts from decreasing to increasing. Thus, an amount of developer material to be discharged from the developer material storage vessel, in which a sufficient amount of developer material is stored, becomes in balance with an amount of developer material to be supplied thereto from the development tank, and hence the amount of developer material in the developer material storage vessel is maintained at a constant level until the number of printed sheets reaches n2. At the time when the number of printed sheets is n2 (6,000 sheets), it is the timing when the toner cartridge and the developer material storage vessel should be replaced, so they are replaced with new ones at the same time. (In this case, it will be convenient if the toner cartridge is integrated with the developer material storage vessel.) After the replacement, similar operations as before are repeated. In this case, as shown in (A3) of FIG. 9, too, the printing quality was within an allowable level even when 200k sheets had been printed.

A problem in the developing apparatus operating as shown in FIG. 10 arises when printing of patterns with extremely many black parts (solidly shaded printing) is successively carried out. When the developer material is fed from the development tank to the developer material storage vessel as usual during such printing is being performed, the concentration of the toner in the developer material storage vessel decreases. When the solidly shaded printing was successively carried out for 100 sheets of paper with this developing apparatus, the toner, concentration of the developer material in the developer material storage vessel decreased from 6% to 3%. If the developer material storage vessel is replaced with a new one in such a state, the balance of the amount of carrier with respect to the entire developer material will be affected. Accordingly, the contents of control were changed in such a manner that the developer material is not discharged from the development tank to the developer material storage vessel during usual or normal printing operation, but the discharge of the developer material is carried out, for example, only at the time of an image quality adjusting mode in which printing operation is not effected or for a limited time before development immediately after the start of printing operation. As a result of such a change, it was possible to maintain the concentration of the toner of the developer material in the developer material storage vessel at 6% even after a series of solidly shaded printing was successively carried out on 100 sheets of paper.

Now, reference will be made to an improvement in the present invention concerning detachable mounting of the developer material storage vessel to the development task. The developer material storage vessel (for instance, the developer material storage vessel 50 shown in FIG. 2) for refreshing the developer material according to an overflow method is provided on its side wall with a receiving port and a discharge port for receiving and discharging the developer material. When the developer material storage vessel mounted to the development tank has been used for a certain period up to a time of replacement thereof, the developer material in the developer material storage vessel comes to a very height near the discharge port. Accordingly, upon replacement of the used developer material storage vessel with a new one, care must be taken not to have the developer material spilt over from the discharge port. In order to cope with this problem, it has been proposed to arrange a shutter or a magnetic seal at each of the receiving port and the discharge port of the developer material storage vessel However, with such a measure alone, it is difficult to completely prevent spilling over of the developer material.

Thus, to avoid the above difficulty, a shutter or a magnetic seal was arranged in each of the receiving port and the discharge port, and at the same time, it was constructed such that the height of the developer material in the developer material storage vessel is lowered when the developer material storage vessel comes to the time of replacement thereof. That is, the developer material storage vessel was divided into two chambers by a partition, so that one of these chambers was used as a conventional developer material storage vessel. When the developer material storage vessel came to the time of replacement thereof, the partition was opened (i.e., the partition was removed or destructed) to lower the height of the developer material in the developer material storage vessel, after which the replacement was carried out. Consequently, the developer material was completely prevented from spilling over because the shutter (or magnetic seal) was installed at each of the receiving port and the discharge port in addition to the fact that the height of the developer material in the developer material storage vessel was lowered.

The developer material storage vessel can be easily integrated with the waste toner box or the toner cartridge from a structural point of view, and there will be no problem even if the contents received in them are mixed with each other. Therefore, they can be integrated with each other. In this case, the respective parts are made to function in accordance with their usage during their normal use, whereas upon replacement thereof, they can be properly made into communication internally with each other so as to lower the height of the developer material in the developer material storage vessel. For instance, the developer material storage vessel can be integrated with the waste toner box, as shown in FIG. 11(*a*). In this case, upon replacement of the waste toner box, a user pulls out a film, which is installed as a partition, as shown in FIG. 11(*a*), before actually detaching the waste toner box, whereby the developer material stored in the developer material storage vessel flows into the waste toner box side as shown in FIG. 11(*b*), and as a result, the height of the developer material in the developer material storage vessel is lowered. In this case, it is preferable that when the user operates a prescribed lever, a predetermined mechanism be, operated to open the partition, thereby placing the developer material storage vessel and the waste toner box into communication with each other. It is also preferable to construct such that an image forming apparatus be automatically operated to open the partition according to a user's instruction.

Embodiment 4

Figure 12:
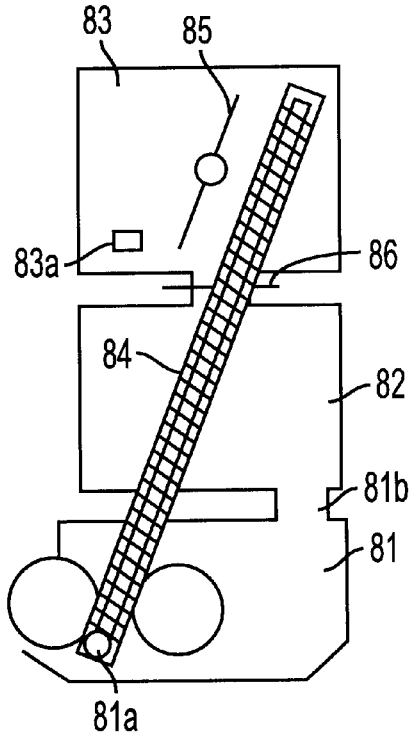
FIG. 12 is a cross sectional view illustrating a fourth embodiment of the developing apparatus of the present invention.
Figure 13A:
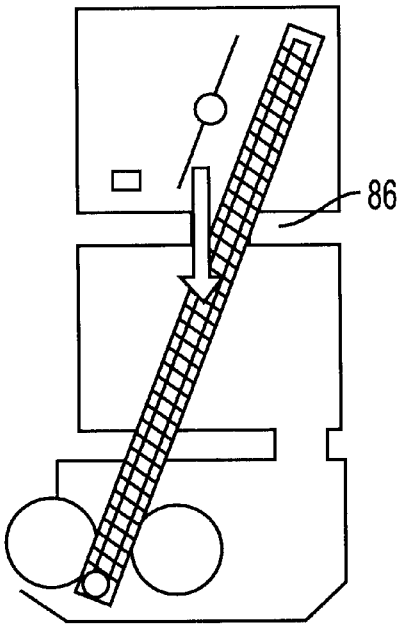
FIG. 13(*a*) is a view illustrating that a shutter of the developing apparatus of FIG. 12 is opened.
Figure 13B:
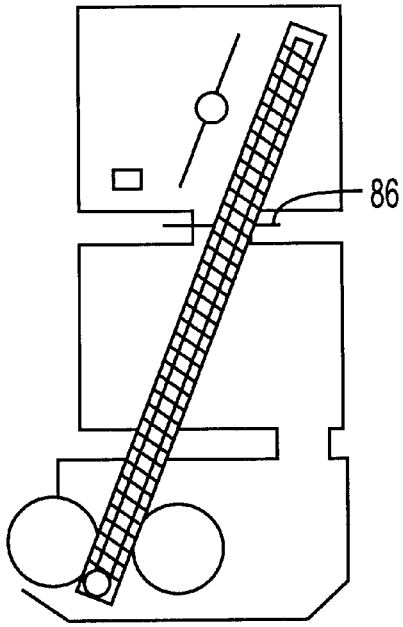

Now, reference will be made to a fourth embodiment of the present invention while referring to FIG. 12 and FIG. 13. As shown in FIG. 12, a development tank 81 is provided with a discharge part 81*a* for discharging a developer material and a receiving part 81*b* for receiving a developer material. The receiving part 81*b* receives the developer material replenished from a developer material replenishment tank 82. A developer material storage part 83 with a developer material containing a high concentration of toner filled therein is detachably or removably mounted on an upper portion of the developer material replenishment tank 82. In addition, a toner concentration sensor 83*a* is mounted on the developer material storage part 83 for detecting the concentration of the toner in the developer material stored therein. The developer material discharged from the discharge part 81*a* of the development tank 81 is fed to the developer material storage part 83 by the conveyor means 84, stirred there and mixed with the developer material containing a toner of a high concentration filled therein by means of a stirring device 85. When it is detected by the toner concentration sensor 83*a* that the developer material in the developer material storage part 83 mixed and stirred by the stirring device 85 has reached a concentration substantially equal to a target concentration of the developer material in the development tank 81, a shutter 86 is opened, as shown in FIG. 13(*a*), and the developer material in the developer material storage part 83 is moved to the developer material replenishment tank 82. Thereafter, the shutter 86 is closed again, as shown in FIG. 13(*b*).

In the above case, let us assume that the target concentration of the toner in the developer material in the development tank 81 is 6%; the total weight of the developer material in the development tank is 212.77 g; and the total weight of the developer material in the developer material replenishment tank 82 is 425.5 g for instance. In this case, when the toner is to be replenished in the developer material storage part 83, the toner can be fed only by at most about 25 g per cycle. The reason is as follows. That is, the concentration of the toner in the developer material discharged from the development tank 81 is lower than 6% and the concentration of the toner in the developer material storage part 83 is about 80% at the time of initialization, and hence in order to mix them with each other to form a developer material containing a toner of 6%, it is necessary to reduce the toner stored beforehand in the developer material storage part 83 to a very small amount, or to extremely increase the amount of the developer material stored in the development tank 81 or in the developer material replenishment tank 82. For instance, let us assume that the concentration of the toner discharged from the development tank is about 3% when the target concentration of the toner in the development tank is 6%. Here, where the toner in the amount of 160 g and the carrier in the amount of 40 g are contained beforehand in the, developer material storage part, in order to provide a developer material of a 6% toner concentration by adding a developer material of a 3% toner concentration to the developer material in the developer material storage part, it is necessary to return from the development tank to the developer material storage part the developer material in an amount of X (g) which is calculated from the following equation:

$$160(g)+3\times/100(g)=6/100(\times+200)(g)$$

That is, it is necessary for each of the developer material storage part and the developer material replenishment tank to have a capacity for storing the developer material of X (g)=about 5,000 g, as a result of which the apparatus is increased in its size. If the capacity is assumed to be about 500 g, the amount of toner, which can be replenished when the developer material storage part is replaced once, becomes about 25 g as mentioned above.

The developing apparatus shown in FIG. 12, though having the defect as described above, includes a lot of advantages. That is, any special control is not needed for discharging the developer material from the development tank 81, and there is no need for providing toner concentration sensors on the development tank 81 and the developer material replenishment tank 82. In addition, even if the formation of images extremely consuming toner is continuously performed as in the case of printing patterns having extremely many black portions, the developer material can be discharged from the development tank 81 at a relatively high speed. Therefore, it does not take time to recover the concentration of the toner in the development tank 81. Additionally, the toner concentration of the developer material being replenished to the development tank 81 is set in advance to the target toner concentration of the developer material in the development tank 81. Accordingly, it can be avoided that the toner concentration of the developer material might become excessively high, making it possible to carry out stable image formation at all times.

In the developing apparatus shown in FIG. 12 and FIG. 13, the following experiments were carried out. Printing was effected with a developer material having a total weight of 25 g and a toner concentration of 80% received in the developer material storage part 83. That is, when a pattern of an A4 size with a printing rate of 5% was printed on 800 sheets of paper, the toner concentration of the developer material in the developer material storage part 83 became 6% and the total weight thereof became about 450 g. At this point, the shutter 86 was opened so that the developer material in the developer material storage part 83 was caused to move to the developer material replenishment tank 82. In this case, the developer material in the developer material replenishment tank 82 had been supplied to the development tank 81 and then fed to the developer material storage part 83 via the development tank 81 by the conveyor means 84 until that time. As a result, an enough space was secured in the developer material replenishment tank 82. When the developer material storage part 83 was emptied, the shutter 86 was closed.

After the closure of the shutter 86, the developer material was fed from the development tank 81 to the developer material storage part 83 by the conveyor means 84 as printing was performed again. When the amount of carrier contained in the developer material accumulated in the developer material storage part 83 became substantially equal to the amount of the carrier (5 g) at the time of initialization, the developer material storage part 83 was removed and it was replaced with a new developer material storage part 83. Thus, the amount of carrier contained in the developing apparatus was not changed, and the carrier was refreshed with a new one little by little each time the developer material storage part 83 was replaced with a new one. According to this proposition, it is possible to perform the replenishment and recovery of the developer material with the developer material storage part 83, that is, one toner cartridge, and such replenishment and recovery of the developer material can be carried out without the need of dividing the interior of the cartridge into separate chambers.

Embodiment 5.

Figure 14:
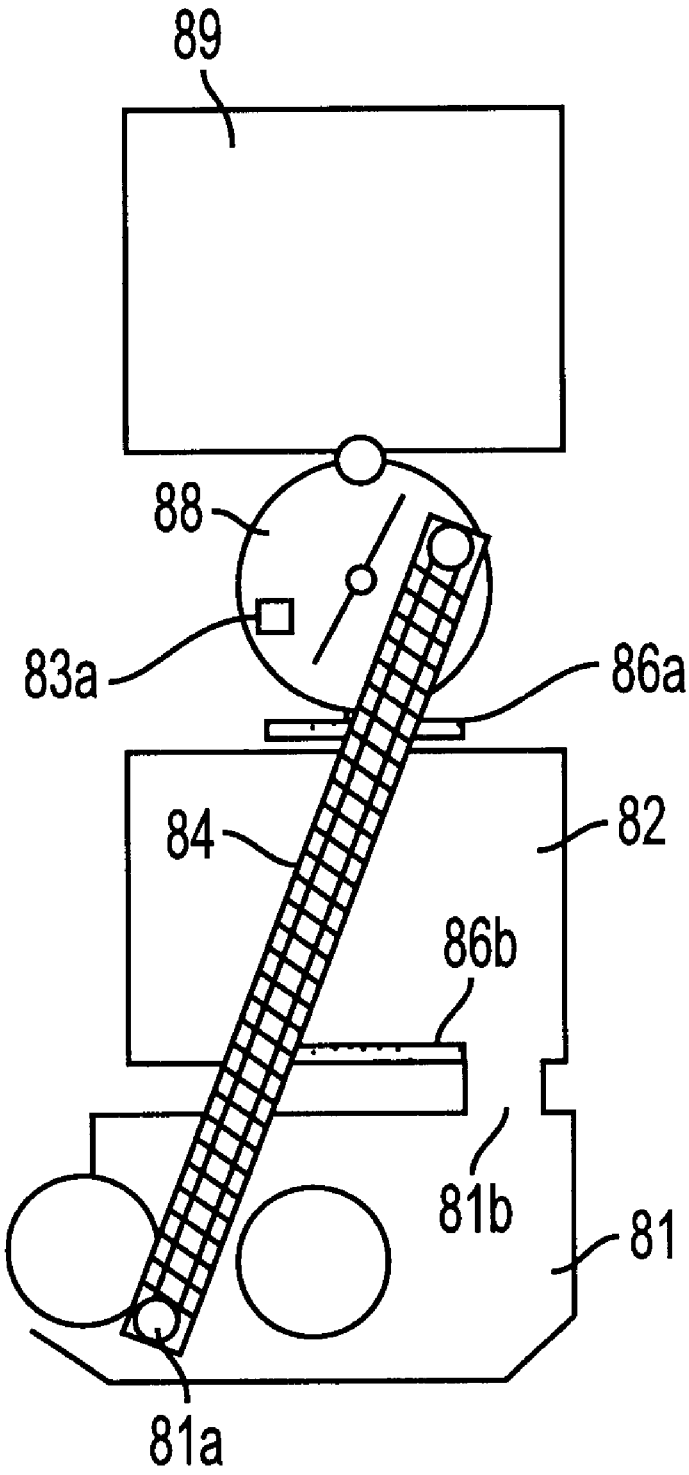
FIG. 14 is a cross sectional view illustrating a fifth embodiment of the developing apparatus of the present invention.

Reference will be made to a fifth embodiment of the present invention while referring to FIG. 14. Although the developing apparatus shown in FIG. 12 and FIG. 13 is excellent in the performance as described above, it has a problem that the amount of toner and the amount of carrier which can be exchanged at one time are small. Thus, FIG. 14 illustrates an improved developing apparatus. In this developing apparatus, a developer material stirring tank 88 is arranged at the position of the developer material storage part 83 of the developing apparatus of FIG. 12, and a toner storage part 89 is arranged at a location above the developer material stirring tank. It is convenient to make the developer material replenishment tank 82 detachable or removable though the developer material stirring tank 88 need not be removable. This is because there is no need for a toner concentration sensor, a stirring blade or vane of a complicated construction or the like, thus making it possible to reduce the cost of the developer material replenishment tank 82.

Figure 15:
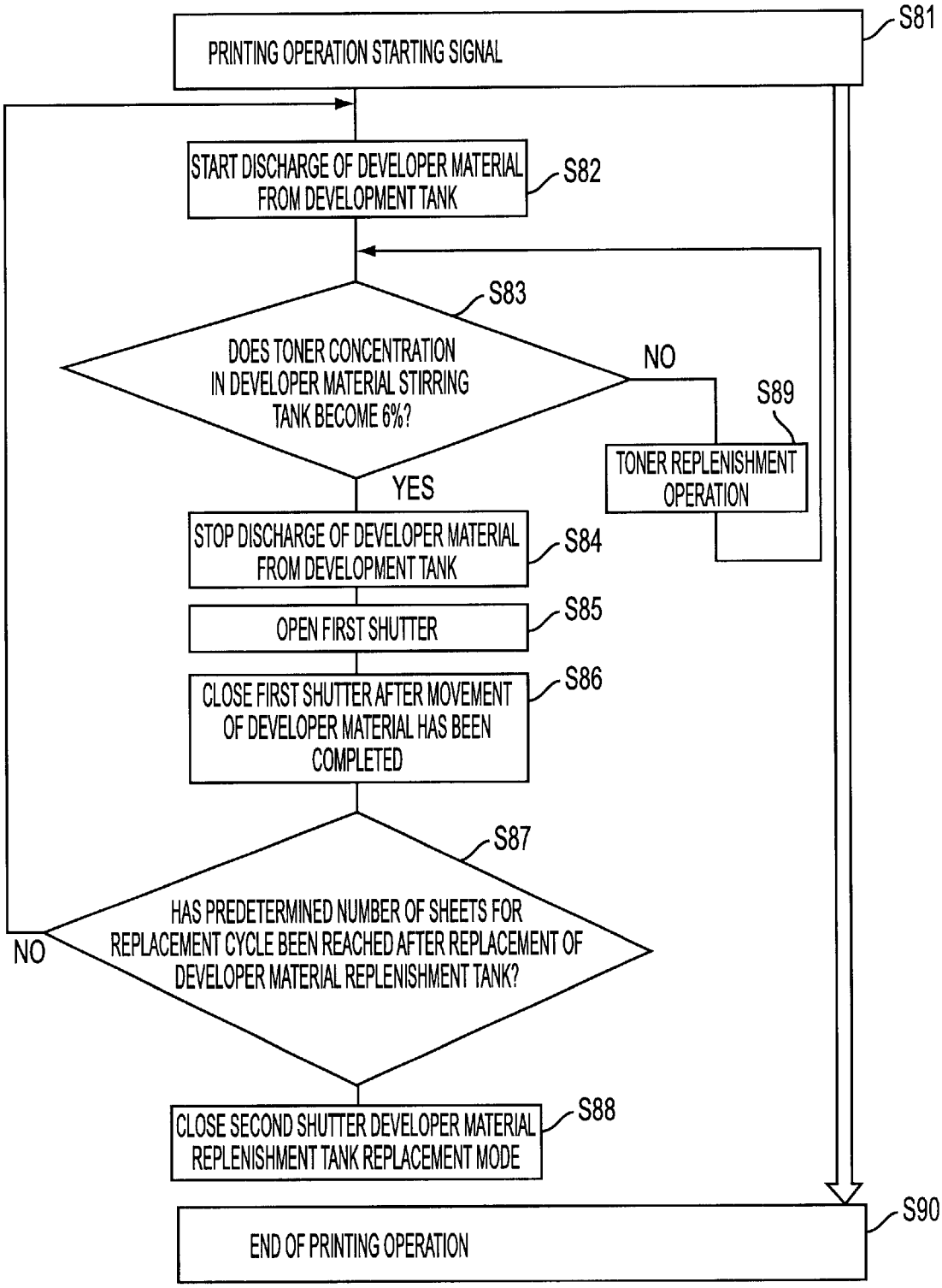
FIG. 15 is a flow chart explaining the operation of the developing apparatus of FIG. 14.

Now, reference will be made to the operation of the developing apparatus of FIG. 14 while referring to a flow chart of FIG. 15. The developer material in the development tank 81 has a toner concentration of 6% and an amount of carrier of 200 g, and hence the total amount of toner and carrier is 212.77 g. A developer material in the amount of 85 g with the same toner concentration as that of the developer material in the development tank 81 is filled in the developer material replenishment tank 82, and hence the amount of the carrier therein is 80 g. When printing by the image forming apparatus is started under the above conditions (S81), the printing operation is continued until it is finished (S90). In accordance with the operation of the main motor, the developer material is discharged from the development tank 81 to the developer material stirring tank 88 (S82). The concentration of the toner in the developer material discharged from the development tank 81 has of course decreased if printing has been carried out. Thus, in the developer material stirring tank 88, the developer material fed thereto from the development tank 81 and the fresh toner also fed thereto from the toner storage part 89 are mixed with each other, so that the toner concentration of the developer material in the development tank 81 is adjusted to be the target concentration of the toner of 6% in the development tank 81 (S83).

When the concentration of the toner in the developer material stirring tank 88 has become 6% through the above adjustment, the discharge of the developer material from the development tank 81 is stopped (S84). Then, a first shutter 86*a* is opened so that the developer material in the developer material stirring tank 88 is caused to move into the developer material replenishment tank 82 (S85). In this case, note that the reason for stopping the discharge of the developer Material from the development tank 81 at the time of opening the first shutter 86*a* is to maintain the concentration of the toner in the development tank 81 at a more constant value. When the movement of the developer material from the developer material stirring tank 88 to the developer material replenishment tank 82 has been completed, the first shutter 86*a* is closed (S86). Thereafter, it is determined whether it comes to the timing of replacement of the developer material replenishment tank 82 (S87). When it is not the timing of replacement, a return is performed to step S82, whereas when it is the timing of replacement, the developer material replenishment tank 82 is replaced with a new one (S88). Upon replacement of the developer material replenishment tank 82, the developer material of the 6% toner concentration is fed from the developer material stirring tank 88 to the developer material replenishment tank 82 so that the developer material in an amount equal to that of the developer material stored in the developer material replenishment tank 82 at the time of initialization is maintained therein, and thereafter replacement of the developer material replenishment tank 82 is carried out. As a result, a constant amount of developer material can be replaced with a new one at all times.

Embodiment 6

Unlike the developing apparatus of FIG. 14, not only the toner but also the developer material may be stored and mixed with each other in the toner storage tank beforehand. In This case, the concentration of the toner should of course be higher than the concentration of the toner in the development tank. However, the developer material and the toner are replenished at the same time, so replacement of the developer material can be performed without making the developer material replenishment tank and the stirring tank removable. In this case, however, what can be replaced is the toner storage part alone, so it is necessary to recover or collect a part of the developer material from the development tank, the developer material stirring tank, etc., to the toner storage part.

Figures 16, 17:
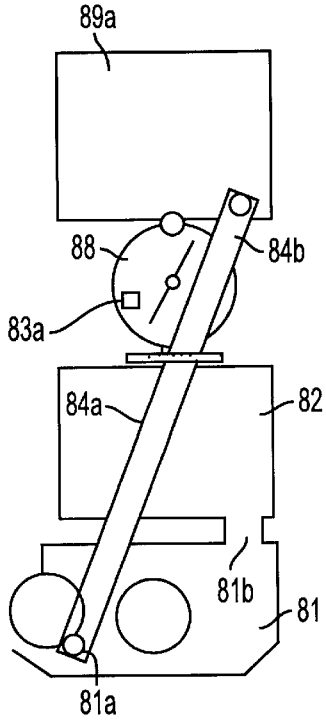
FIG. 16 is a cross sectional view illustrating a sixth embodiment of the developing apparatus of the present invention.
FIG. 17 is a view illustrating the results of life tests of the developing apparatuses of FIG. 14 and FIG. 16.

FIG. 16 is a developing; apparatus constructed based on the above-mentioned concept. In this example, the toner storage part is constructed as a developer material storage box 89*a*. That is, in the developing apparatus of FIG. 16, returning of the developer material from the development tank 81 to the developer material stirring tank 88 is effected by a conveyor means 84*a*, and conveyance of the developer material from the developer material storage box 89*a* to the developer material stirring tank 88 is carried out by a conveyor means 84*b*. The conveyor means 84*b* usually supplies the developer material of a high toner concentration from the developer material storage box 89*a* to the developer material stirring tank 88. On the other hand, when the developer material in the developer material storage box 89*a* is depleted, the conveyor means 84*b* operates to convey (in a reverse direction) the developer material in the developer material stirring tank 88 toward the developer material storage box 89*a*. That is, when an amount of carrier substantially equal to the amount of carrier gradually supplied from the developer material storage box 89*a* has been recovered or collected to the developer material storage box 89*a*, the developer material storage box 89*a* is replaced with a new one, and the operation of the apparatus is returned to the original one. As a consequence, it is possible to refresh the carrier in the development tank 81 little by lettle without changing the amount of carrier therein, whereby the service life of the developer: material in the development tank 81 can be prolonged.

FIG. 17 shows the results of life tests for the developing apparatuses of FIG. 14 and FIG. 16. In case of the developing apparatus of FIG. 14, the developer material of 85 g in the developer material replenishment tank was replaced with a new one each time 20k sheets of paper were printed, whereas in case of the developing apparatus of FIG. 16, replacement of the developer material was carried out each time 6k sheets of paper were printed. In addition, a pattern with a printing rate of 5% was printed on a sheet of printing paper of an A4 size. In the case where printing was effected without changing the developer material at all, printing defects exceeded an allowable level at the time when about 60k sheets were printed, as shown in (B1) of FIG. 17. In the case where printing was effected using the developing apparatuses of FIG. 14 and FIG. 16, printing quality was within an allowable level even at the time when 200k sheets were printed, as shown in (B2) and (B3), respectively, of FIG. 17.

A developing apparatus of the present invention is constructed as described in the foregoing. Thus, a developer material refreshing means mechanically forces a development tank to supply and receive a toner and a carrier constituting a developer material so as to prevent a change in the amount of the developer material and a change in the concentration of the toner in the development tank, whereby the amount of developer material and the concentration of the toner in the development tank are maintained constant, and at the same time, the service life of the developer material is prolonged.

What is claimed is:

1. A developing apparatus for supplying a developer material composed of a toner and a carrier to a photoreceptor to visualize a latent image formed on the receptor, said apparatus comprising:

a development tank for storing the developer material;

a development roller for supplying the developer material in said development tank to the photoreceptor;

a developer material storage vessel for storing a developer material;

discharging means for discharging a portion of the developer material in said development tank to said developer material storage vessel; and conveying means for conveying a portion of the developer material in said developer material storage vessel to said development tank.

2. The developing apparatus according to claim 1, further comprising:

toner concentration adjusting means for supplying a toner to the developer material stored in said development tank thereby to set the concentration of the toner therein to a target toner concentration;

wherein the developer material storage vessel is detachably mounted on said development tank and stores developer material of the target toner concentration; and wherein a developer material discharging and receiving mechanism mixes the developer material stored in said development tank with the developer material stored in said developer material storage vessel by a prescribed amount, and circulates the mixture into said development tank without giving a change equal to or greater than a predetermined amount to the amount of developer material stored in said development tank.

3. The developing apparatus according to claim 1, wherein said discharging means and conveying means respectively discharge and convey a prescribed proper amount of developer material from and to said development tank, the developing apparatus further comprising:

developer material replenishment means for storing a developer material of a target toner concentration and supplying the developer material in such a manner that the, amount of developer material stored in said development tank becomes constant, wherein said developer material storage vessel is detachably mounted on said developer material replenishment means and stores a high concentration developer material of a toner concentration higher than the target toner concentration, mixes the developer material discharged from said discharging means with the high concentration developer material, and delivers the mixed developer material to said developer material replenishment means when the toner concentration of the mixed developer material has reached the target toner concentration.

4. The developing apparatus according to claim 1, wherein said discharging means and conveying means respectively discharge and convey a prescribed proper amount of developer material from and to said development tank, the developing apparatus further comprising:

developer material replenishment means for storing a developer material of a target toner concentration and supplying the developer material in such a manner that the amount of developer material stored in said development tank becomes constant;

toner replenishment means for replenishing the amount of the toner; and developer material stirring means for mixing the developer material discharged from said discharging means and the toner from said toner replenishment means with each other to produce a mixed developer material, and delivering the mixed developer material to said developer material replenishment means when the toner concentration of the mixed developer material has reached the target toner concentration;

wherein said developer material replenishment means is removable from said development tank and said developer material stirring means connected therewith.

5. The developing apparatus according to claim 1, wherein said discharging means and conveying means respectively discharge and convey a prescribed proper amount of developer material from and to said development tank, and said developer material storage vessel stores a high concentration developer material of a toner concentration higher than a target toner concentration, the developing apparatus further comprising:

developer material replenishment means for storing a developer material of the target toner concentration and supplying the developer material in such a manner that the amount of developer material stored in said development tank becomes constant; and developer material stirring means for mixing the developer material discharged from said discharging means and the high concentration developer material in said developer material storage vessel to produce a mixed developer material, and delivering the mixed developer material to said developer material replenishment means when the toner concentration of the mixed developer material has reached the target toner concentration;

wherein when said developer material storage vessel is emptied, said conveying means conveys the developer material in a reverse direction from said developer material stirring means to said developer material storage vessel so that an amount of carrier stored in said developer material storage vessel at the time of initialization is maintained in said developer material storage vessel so as to make it possible to replace said developer material storage vessel with a new one.

6. A developing apparatus in which a predetermined amount of developer material composed of a toner and a carrier stored in a development tank is stirred by stirring means and supplied to a latent image, which is formed on a photoreceptor in accordance with an electrophotographic method, by a development roller arranged in the development tank to visualize the latent image, a concentration of a toner consumed in the development tank being detected by a toner concentration sensor whereby the toner in the toner storage tank is supplied to the development tank so as to maintain the toner concentration therein at a constant value, said developing apparatus comprising:

developer material discharging means for mechanically discharging the developer material from the development tank;

developer material receiving means for receiving the developer material into the development tank;

developer material storage means detachably mounted on said developer material discharging means and said developer material receiving means for storing in advance the same developer material as that stored in the development tank at the time of initialization; and control means for driving said developer material discharging means to discharge a predetermined amount of developer material from the development tank to the developer material storage means so as to mix the developer material discharged from the development tank and the developer material already stored in the developer material storage means with each other, said control means further driving the developer material receiving means in such a manner that the development tank is made to receive from the developer material storage means an amount of mixed developer material corresponding to an amount of developer material discharged from the development tank.

7. The developing apparatus according to claim 6, wherein the developer material, which is caused to circulate through said developer material storage means by said control means, is a developer material whose height in the development tank becomes equal to or higher than a predetermined height level.

8. The developing apparatus according to claim 6, wherein a conveyance capacity of said developer material receiving means for conveying the developer material is greater than that of said developer material discharging means.

9. The developing apparatus according to claim 6, wherein a discharge port, through which said developer material discharging means discharges the developer material from the development tank, and a receiving port, through which said developer material receiving means makes the developer material received in the development tank, are set at locations opposing to each other in such a manner that a distance between said discharge port and said receiving port in the development tank is longer than a direct distance therebetween in a straight line.

10. The developing apparatus according to claim 6, wherein said control means circulates the developer material through said developer material storage means when image formation is not performed.

11. The developing apparatus according to claim 6, wherein said developer material storage means is integral with said toner storage tank.

* * * * *